United States Patent [19]

Kudlich

[11] 4,141,231

[45] Feb. 27, 1979

[54] MACHINE FOR APPLYING PATTERNS TO A SUBSTRATE

[75] Inventor: Hans Kudlich, Kufstein, Austria

[73] Assignee: Maschinenfabrik Peter Zimmer Aktiengesellschaft, Kufstein, Austria

[21] Appl. No.: 709,550

[22] Filed: Jul. 28, 1976

[30] Foreign Application Priority Data

Jul. 28, 1975 [AT] Austria ..... 5812/75

[51] Int. Cl.[2] ..... B05B 7/00; B05C 5/00; D06B 1/02

[52] U.S. Cl. ..... 68/205 R; 118/7; 118/314; 118/132 S; 118/33

[58] Field of Search ..... 68/205 R, 205; 239/584, 239/585; 118/7, 325, 305, 313, 315, 323, 324, 326, 314, 33

[56] References Cited

U.S. PATENT DOCUMENTS

| | | | |
|---|---|---|---|
| 1,529,134 | 3/1925 | Kelter | 118/325 |
| 3,271,102 | 9/1966 | Morgan | 68/205 R |
| 3,443,878 | 5/1969 | Weber et al. | 68/183 X |
| 3,797,756 | 3/1974 | Voit et al. | 239/585 |
| 3,969,779 | 7/1976 | Stewart | 68/205 R |
| 3,985,006 | 10/1976 | Klein | 68/205 R |

*Primary Examiner*—Louis K. Rimrodt
*Attorney, Agent, or Firm*—Montague & Ross

[57] ABSTRACT

A substrate to be patterned, such as a textile web, is moved past an array of nozzles with discharge orifices closely spaced from its surface, the substrate being firmly backed at locations confronting the nozzles by being drawn against a supporting conveyor or by being led around rollers. The nozzles are electromagnetically operated by needle valves, the valve needles being carried by membranes under substantially balanced pressures from the printing liquor and from a fluid such as compressed air. The electromagnetic coils are energized by a generator of short current pulses separated by a low holding current, the generator including two complementary power transistors in series with a coil winding. A dyestuff applicator carrying one or more of such nozzles may be transversely displaceable across the substrate, under the control of a programmer, between intermittent advances of the substrate in its longitudinal direction.

20 Claims, 14 Drawing Figures

MACHINE FOR APPLYING PATTERNS TO A SUBSTRATE

FIELD OF THE INVENTION

My present invention relates to an apparatus for applying patterns to a substrate, especially a sheet of fabric or the like, as well as to a spray nozzle to be used for this purpose.

BACKGROUND OF THE INVENTION

In conventional printing systems a pattern is generally applied to a substrate by way of a suitably apertured screen. Recently, attempts have been made to form patterns on sheets with the aid of highly directive nozzles without the use of a printing screen. Heretofore, however, the quality of goods treated in this manner has been less than satisfactory.

OBJECTS OF THE INVENTION

An object of my present invention is to provide an apparatus for avoiding this drawback in patterning a substrate by the direct-spray technique.

Another object is to provide an improved spray nozzle particularly adapted for this purpose.

SUMMARY OF THE INVENTION

In accordance with my present invention, nozzles programmed to produce a pattern of one or more colors on a substrate moving relatively thereto are disposed in the immediate vicinity of the suitably supported substrate.

In order to provide a wide range of color shades, the intensity of the spray may be made variable by mounting each nozzle on a wall of a dye chamber in which printing liquid is received under electromagnetically adjustable pressure.

According to another feature of my invention, the nozzles are electromagnetically operated and are provided for this purpose with orifices adapted to be selectively blocked and unblocked by associated needle valves, the needle of each valve being coupled with a magnetic armature and being advantageously mounted in an adjacent dyestuff chamber on a flexible membrane subjected to a balancing pressure which partly or completely compensates (or possibly overcompensates) the pressure of the printing liquor or dyestuff in the chamber. With high-frequency pulsing of an electromagnetic coil winding coacting with the armature, the dyestuff is discharged in short spurts to form tiny dots whose density varies with the pulse frequency which may be on the order of Kilohertz.

BRIEF DESCRIPTION OF THE DRAWING

My invention will now be described in detail with reference to the accompanying drawing in which.

SPECIFIC DESCRIPTION

Figure 1:
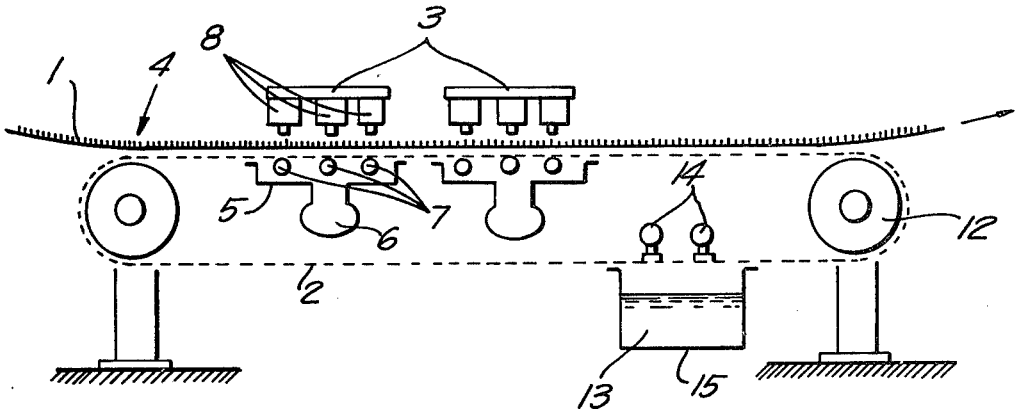
FIG. 1 is a longitudinal sectional view of a printing machine embodying the invention.

FIG. 1 shows a substrate 1 which is transported by an endless conveyor 2 past several sets of dyestuff applicators 3. Conveyor 2, led around rollers 12, may consist of woven wire mesh or of a perforated sheet of polymeric material such as vulcanized rubber or plastic of limited longitudinal extensibility. The substrate 1, which may be a web of fabric continuously drawn from a nonillustrated supply roll, enters the machine at 4 and passes between the conveyor 2 and the applicators 3. Below the conveyor, in line with each set of applicators, there is provided a suction box 5 in which a partial vacuum is produced by a nonillustrated blower whose low-pressure side communicates with a duct 6. The magnitude of this vacuum may range between about 100 and 1000 mm of water column substantially equivalent to 0.01 - 0.1 atmosphere. This partial vacuum firmly nolds the conveyor 2 together with the overlying substrate 1 onto supporting rollers 7, thereby maintaining a well-defined separation between the substrate and the applicator nozzles 8. This separation may range between several millimeters and a fraction of a millimeter; in an extreme case the nozzles could even touch the substrate. Advantageously, as illustrated, the nozzles 8 are precisely aligned with respective supporting rollers 7.

Figure 2:
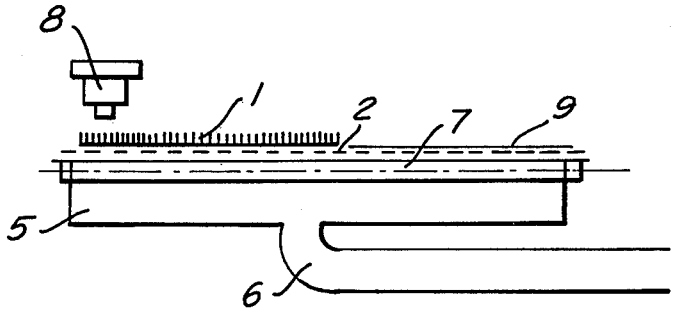
FIG. 2 is a cross-sectional view of part of the machine shown in FIG. 1.
Figure 3:
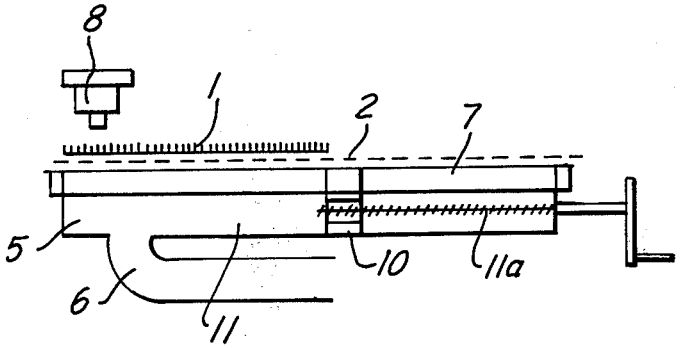
FIG. 3 is a view similar to FIG. 2, illustrating a modification.

In order to accommodate substrates of widely different widths, and air-impermeable cover 9 may be disposed on the suction box 5 alongside a narrower substrate as shown in FIG. 2. Alternatively, a lateral partition 10 transversely shiftable by a leadscrew 11*a* can be disposed in the suction box (see FIG. 3) to confine the vacuum to a space 11 directly below the substrate.

FIG. 1 further shows a washing station 13 traversed by the conveyor after it passes around the outlet-side roller 12, this station comprising a set of sprinklers 14 above the lower run of the conveyor and a trough 15 below it. The trough could also be provided with a nonillustrated suction device to expedite the drying of the conveyor.

The use of a partial vacuum to hold the substrate to its carrier in the region of the nozzles has the added advantage of promoting, in a manner known per se, the penetration of the dyestuff into the interstices of the substrate.

Figure 4:
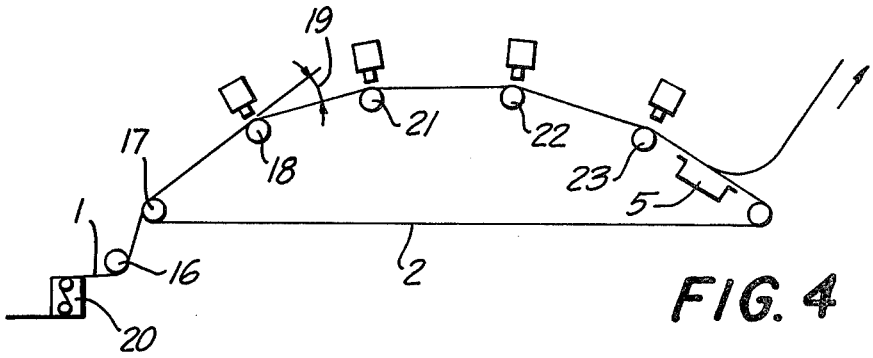
FIG. 4. is a diagrammatic elevational view of an alternate embodiment.

FIG. 4 shows a modified printing machine particularly designed for coarse fabrics or other wide-mesh substrates which would require a high degree of suction in order to be held firmly onto the conveyor or other support. In such a case it is advantageous to guide the substrate 1 along an upwardly convex path defined, downstream of an entrance roller 16, by a set of support rollers 17 – 23 aligned with respective nozzles. At each roller 18 – 23, the substrate is deflected downwardly by a small angle 19 and thus held under tension against that roller. This tension may be imparted to the substrate, upstream of the first deflecting roller 16, by a friction brake 20 and may be maintained downstream of the last roller 23 by a suction box 5 similar to those described above. Such a suction box could be omitted if the conveyor 2 is studded in a manner known per se and if the weight of the substrate is high enough to hold that substrate onto the conveyor with a sufficient pressure to prevent its shifting on the studded surface.

Figure 8:
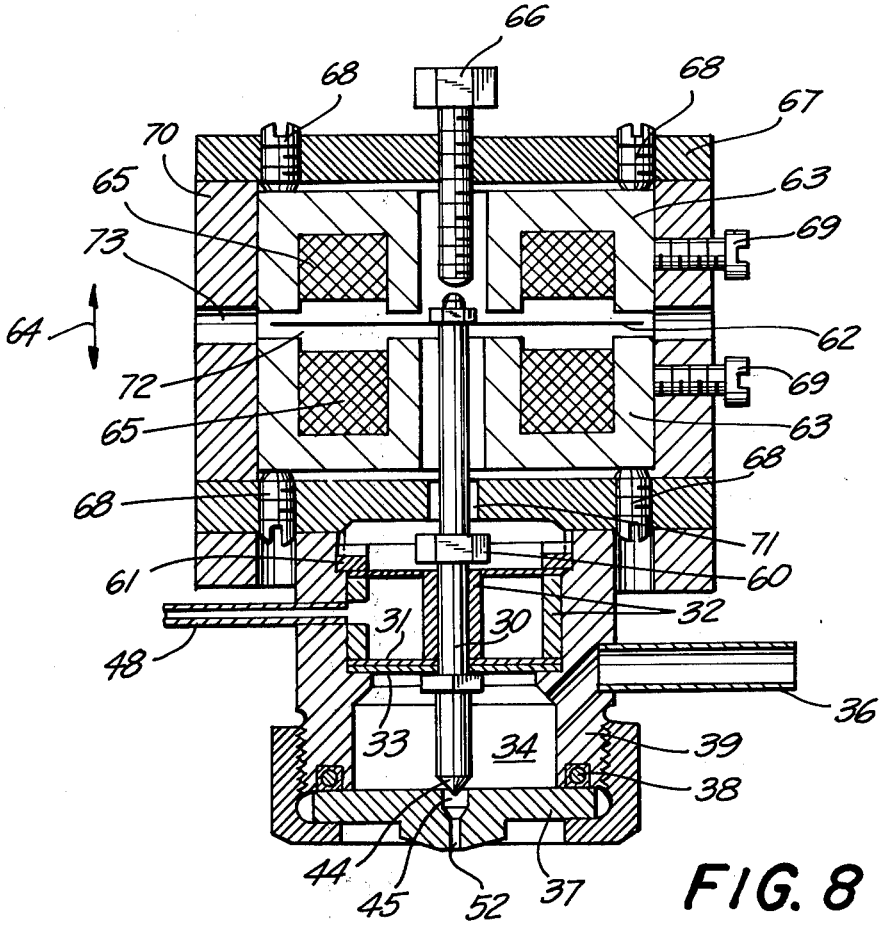
Figure 5:
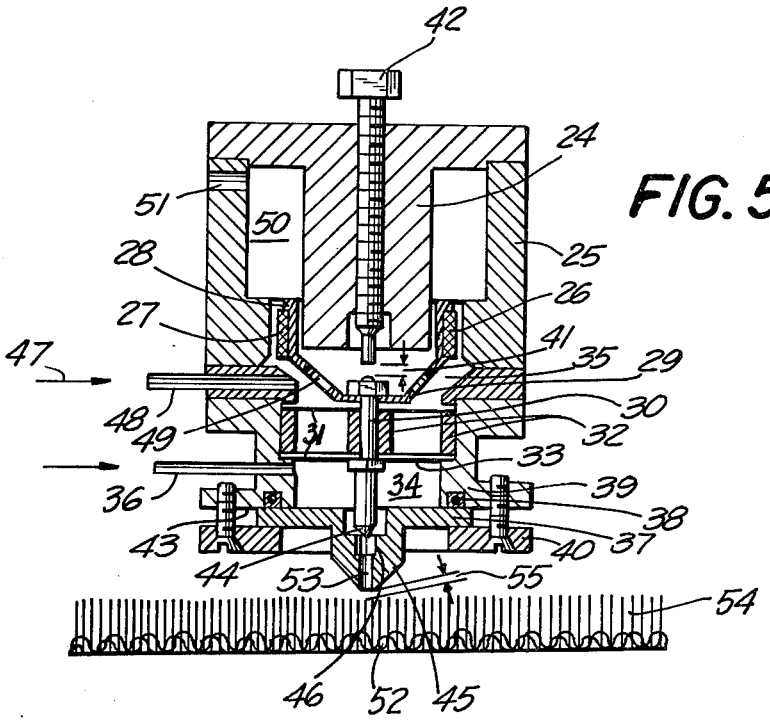
FIG. 5 is an axial sectional view, drawn to a larger scale, of an electromagnetic dyestuff applicator according to my invention adapted to be used in a machine as shown in the preceding FIGS.

FIG. 5 shows an advantageous dyestuff applicator according to the invention. This applicator comprises a permanent magnet 24 forming a central core integral with a flange serving as a cover for an annular space 50 surrounding that core. The flange of magnet 24 rests on a ferromagnetic housing 25 forming a narrow annular gap 26 with the lower end of the core. An annular coil 27 coaxially surrounds that lower end and is vertically movable within the gap 26 while being held on a downwardly tapering carrier 28. This carrier, which has a very small wall thickness, may consist of light metal or of plastic material such as, for example, glass-fiber-reinforced polyester. In order to minimize eddy current the carrier should be slitted if made of metal; it is therefore preferable to use a resinous carrier, despite its lower thermal conductivity, since the absence of a slit enhances its mechanical stability. This stability is further improved by the frustoconical shape of the lower part of the carrier body terminating in a base 29 of small radius to which a depending control needle 30 is attached. Needle 30 is secured to a pair of vertical membranes 31 which are clamped in position, e.g. as shown in FIG. 8 described hereinafter, in order to be held centered on the vertical axis of the applicator. A high-strength magnetic field (e.g. on the order of 15,000 gauss) may be easily maintained in the annular gap 26.

Figure 6:
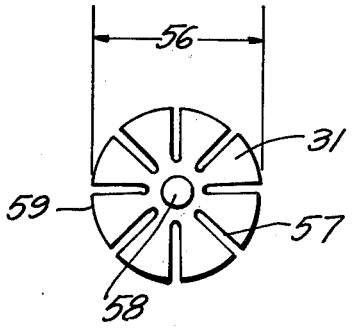
FIG. 6 is a plan view and FIG. 7 is a sectional top view showing details of the dyestuff applicator of FIG. 5.

As seen in FIG. 6, each membrane 31 is formed with a set of radial slots 57 designed to facilitate a deflection of its center 58 relatively to its clamped rim 59. This allows the needle 30 to be raised or lowered by several tenths of a millimeter with only a minimum force. The membranes advantageously consist of thin sheet metal whose thickness should not exceed 1% of their diameter 56.

Figure 7:
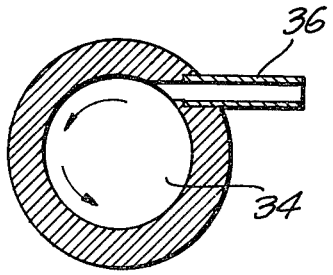

Annular space 50 is vented to the atmosphere at a port 51 and communicates, via gap 26, with a space 35 surrounding the coil carrier 28. Space 35 extends into the region between the membranes 31, owing to the presence of the radial slots 57. A diaphragm 33 of rubber or plastic material separates this space in a fluidtight manner from a dyestuff chamber 34 which opens into a bore 46 of a nozzle 45 integral with a bottom plate 37 closing the chamber 34 from below. Plate 37 lies flat against the underside 43 of a peripheral wall 39 of chamber 34 onto which it is clamped by screws engaging a retaining ring 40; a packing ring 38 in a groove of surface 43 shields the chamber 34 against the atmosphere. Dyestuff can be admitted into chamber 34 via an inlet 36 which, as best seen in FIG. 7, opens tangentially into the chamber to facilitate a cleaning thereof by a rinsing fluid circulating in the direction of the arrows. With a radially extending inlet there would be a tendency to form pockets in which the cleaning action of the rinsing fluid would be greatly diminished.

Needle 30 terminates in a cone 44 which adjustably constricts the bore 46 leading to the orifice 53 of nozzle 45. The outlet end 52 of this orifice is separated from a nap 54 of the substrate by a small distance 55 of, say, 0.5 to 2 mm. The dyestuff in chamber 34 is preferably discharged from orifice 53 at a velocity of at least 10 meters per second; this speed and the small distance 55 insure a penetration of the nap 54 even by a relatively viscous dyestuff with sharp tracing of the strokes of the pattern to be formed thereon. In order to maintain the injection pressure of the dyestuff within chamber 34, a back-up pressure is created in space 35 by the admission of a stream of compressed air 47 into that space through an inlet 48. The two pressures should be about equal but a small difference therebetween may be utilized to accelerate the electromagnetic displacement of needle 30 in a downward or an upward direction to increase or reduce its throttling effect upon the outflow of dyestuff. The compressed air leaves the space 35 by way of vent 51 and, in passing through the gap 26, helps cool the electromagnetic coil 27 which is energized over nonillustrated leads by a circuit described hereinafter with reference to FIG. 14. Coil carrier 28 has apertures 49 designed to equalize the pressure inside and outside its body, these apertures also enabling part of the cooling airstream to circulate along the inner coil surface. Port 51, which may be one of several outlets, may be provided with conventional throttling devices such as screws or valves designed to adjust the air pressure within the applicator and to slow the escape of the admitted air. The stroke 41 of needle 30 is adjustable by a setscrew 42. The shape of the spray leaving the nozzle 45 is determined by the ratio of the length of orifice 53 to its diameter.

FIG. 8 shows a modified applicator whose lower portion, including dyestuff chamber 34 and nozzle plate 37, is practically the same as in FIG. 5. Membranes 31 and 33 are held in position by concentric annular spacers 32, also shown in FIG. 5, with the aid of a hexagonal nut 60 on a threaded upper extremity of needle 30 and a surrounding notched nut 61 with external threads screwed into a recess of peripheral wall 38. The upper end of needle 30, traversing a bore 71 in a plate forming the bottom of a chamber 72, is secured to a ferromagnetic foil 62 preferably of the laminated type. Foil 62 constitutes the armature of a pair of confronting electromagnets with toroidal cores 63 and coils 65, the cores being separated by a narrow axial air gap within which the foil 62 can oscillate vertically as indicated by an arrow 64. These cores advantageously consist of ferrites minimizing the flow of eddy currents and the losses of energy resulting therefrom. The coils 65 of copper wire can be alternately energized to raise or to lower the needle 30. The stroke of the needle is limited by a setscrew 66 threaded into a cover plate 67 which rests on a peripheral wall 70 and carries grub screws 68 which, together with similar screws in the associated bottom plate, serve for a precise adjustment of the position of the cores. This position can be fixed with the aid of setscrews 69. The high-pressure air entering the space 72 via inlet 48 and gap 71 escapes through ports 73 which could again be provided with nonillustrated throttling devices.

The embodiment of FIG. 8 has the advantage, compared with that of FIG. 5, that large magnetic forces can be developed with a small armature mass and that the coil assembly 65 is stationary so as to be energizable by fixed leads which are not damaged by the high-speed needle movements. Moreover, the coils can be made as large as necessary to dissipate the developing heat.

On the other hand, the embodiment of FIG. 5 has the advantage that the ratio of applied force to movable mass can be made as large as desired through the use of sufficient energizing currents for the coil 27. This requires, of course, that sufficient heat can be dissipated by the structure. Thus, one or the other type of applicator may be preferred under given circumstances. In either case the electromagnetic winding should be energized with short rectangular pulses, e.g. of a duration of several tenths or hundredths of a second, followed by a constant current of a magnitude reduced by about a factor of 10. This mode of energization enables high accelerations with the applicator of FIG. 5 whose nozzle can thus be used for the tracing of fine details, albeit with relatively large intervals between pulses during which only the constant holding current flows through the coil 27. Since the construction of FIG. 8 provides better cooling but acceleration is limited by the saturation of the foil 62, this applicator cannot respond so quickly but its nozzle can be opened and closed more frequently within a given time interval. In principle the construction of FIG. 8 is intended for a periodic opening and closure at a rate of about 2000 to 3000 reciprocations per second. Such an operation facilitates particularly the printing of half-tones which is very difficult to achieve with conventional printers of the rotary-screen type. In the case of a printing screen, different color shades are produced by the use of larger or smaller screen apertures; this technique, however, inherently falsifies the relative values of the color shades so that true half-tones cannot be obtained. On the other hand, a quick-acting nozzle according to the invention enables the nozzle orifice to be held open for longer or shorter periods at a frequency which can be held constant or varied at will, in conformity with the desired shade, so that precisely measured quantities of dyestuff can be sprayed onto a unit area of the substrate.

Figure 9:
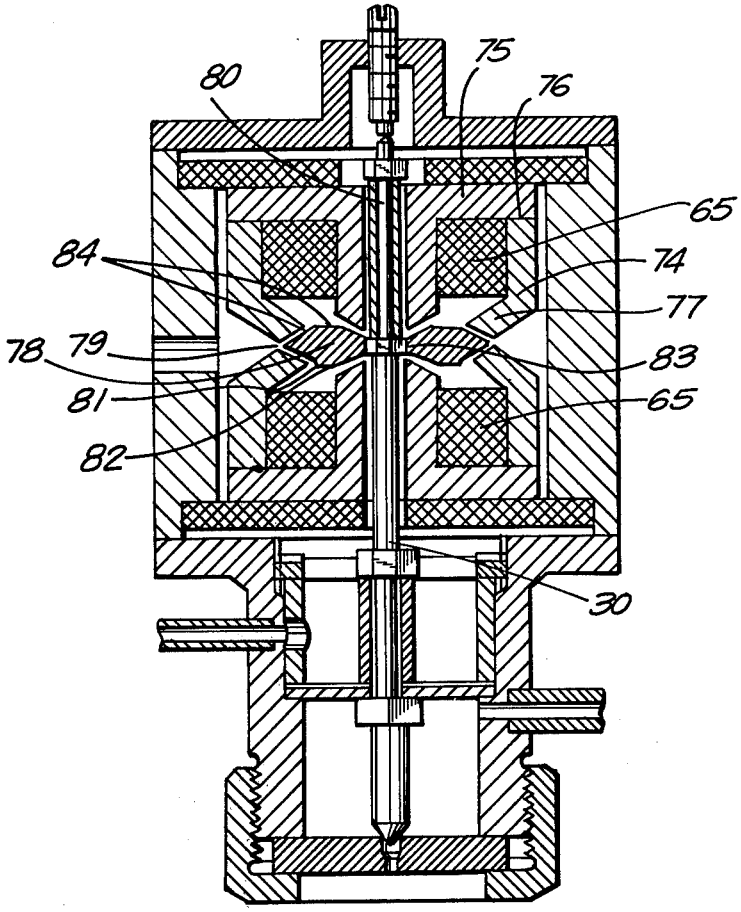
FIGS. 8 and 9 are views similar to FIG. 5, showing modifications of the dyestuff applicator.

FIG. 9 shows another applicator which is generally similar to that of FIG. 8 but wherein the coils 65 are encased in differently shaped holders 74, 75 of ferromagnetic material. The inner holder portion 75 forms a flanged core, similar to that shown at 24 in FIG. 5, surrounded by the coil 65 and bonded at 76 to the outer annular holder portion 74. An insulating layer, e.g. of paper, may be inserted at the joint 76 to prevent the flow of eddy currents. At 77 the holder portion 74 converges frustoconically toward an armature 78 replacing the foil 62 of FIG. 8.

The energization of coils 27, 65 with short high-current pulses at a frequency depending on the desired printing density, alternating with a small holding current, can be carried out by any suitably programmed pulse generator, advantageously one of the type shown in FIG. 14 and described hereinafter.

Armature 78 has an outer peripheral ridge 79 and spreads vertically toward the axis 80. Thus, the annular cross-section of the armature along a cylinder surface centered on that axis increases sharply up to a point 81 and then remains constant to a point 82 whereupon it decreases with shorter radii. A small disk 83 of constant thickness forms the center of the armature and serves to secure it to the needle 30.

This shape is designed to produce large forces with small movable masses. The effective cross-section of armature 79 perpendicular to the flux, i.e. along cylinders of different radii centered on axis 80, is so chosen that the degree of saturation is substantially uniform throughout the armature body. These cross-sections are preferably only about half as large as those which the flux traverses in the coil holders 74, 75. Air gaps 84 between the armature 78 and the coil holders 74, 75 are just wide enough to permit a needle stroke of a few tenths of a millimeter. The coils 65 should be so dimensioned that the armature 78 can reach its saturation without excessive heat development in these coils. A further advantage of this armature configuration is the fact that its mass is concentrated closer to its axis (as compared with a disk-shaped body of constant height such as foil 62) so that its natural frequency shifts to higher values.

Figure 10:
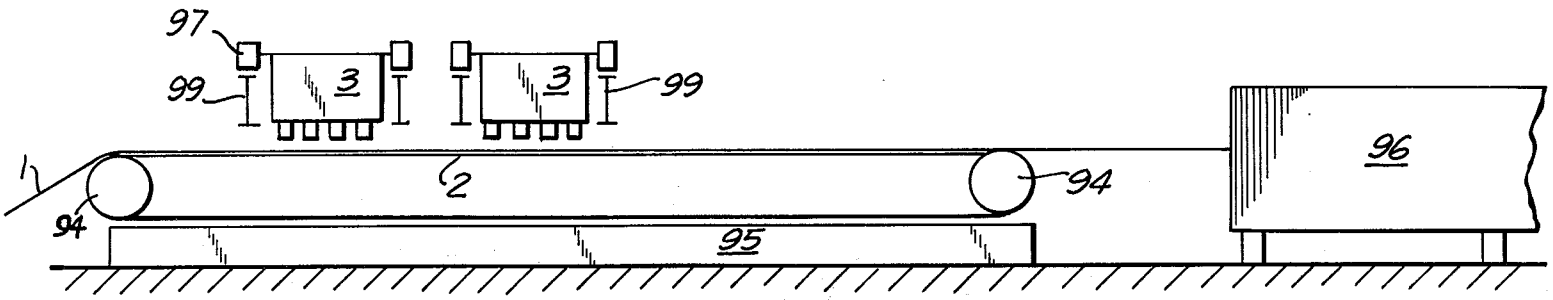
FIG. 10 is a diagrammatic side-elevational view of a machine similar to that shown in FIG. 1 but provided with additional features.
Figure 11:
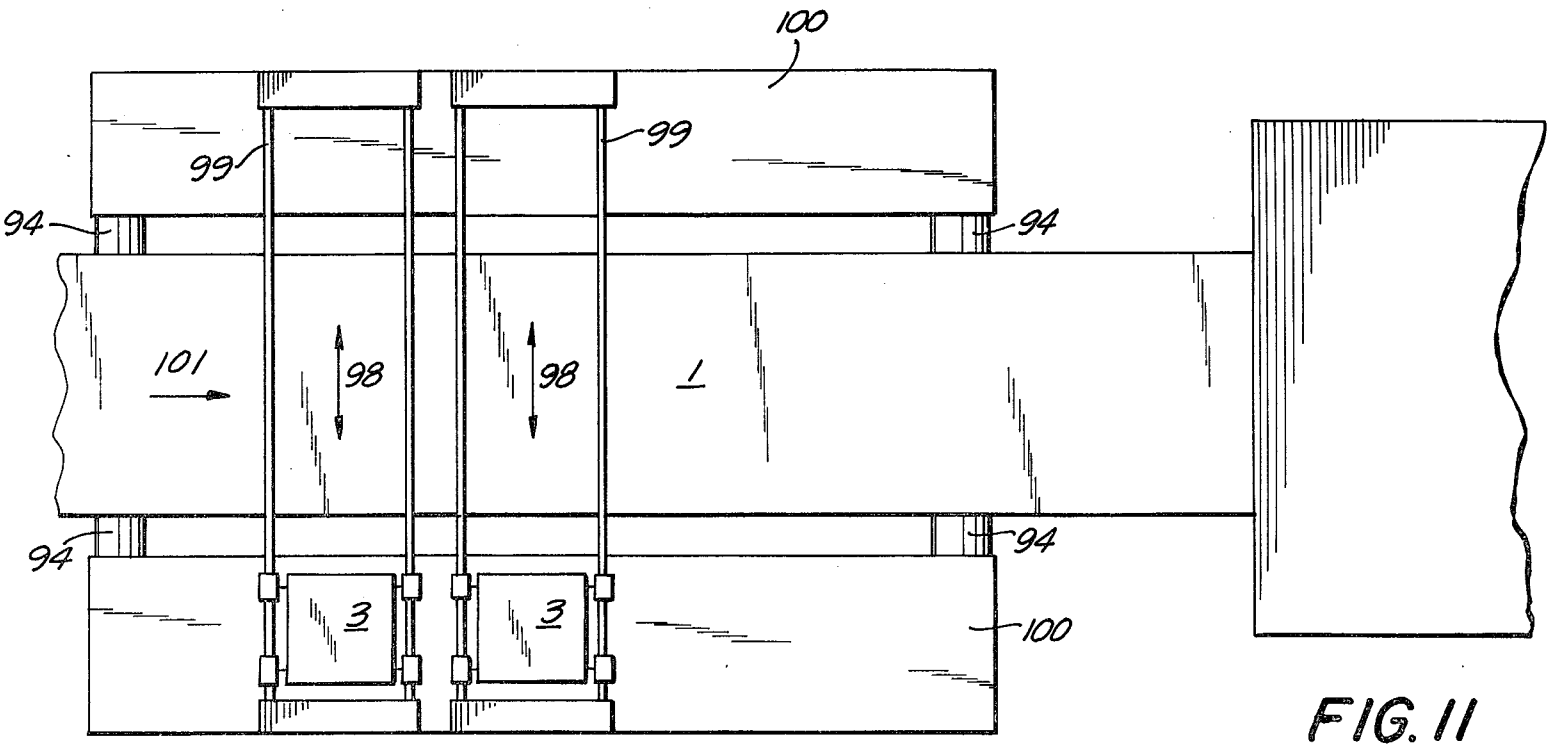
FIG. 11 is a top plan view of the machine shown in FIG. 10.
Figure 12:
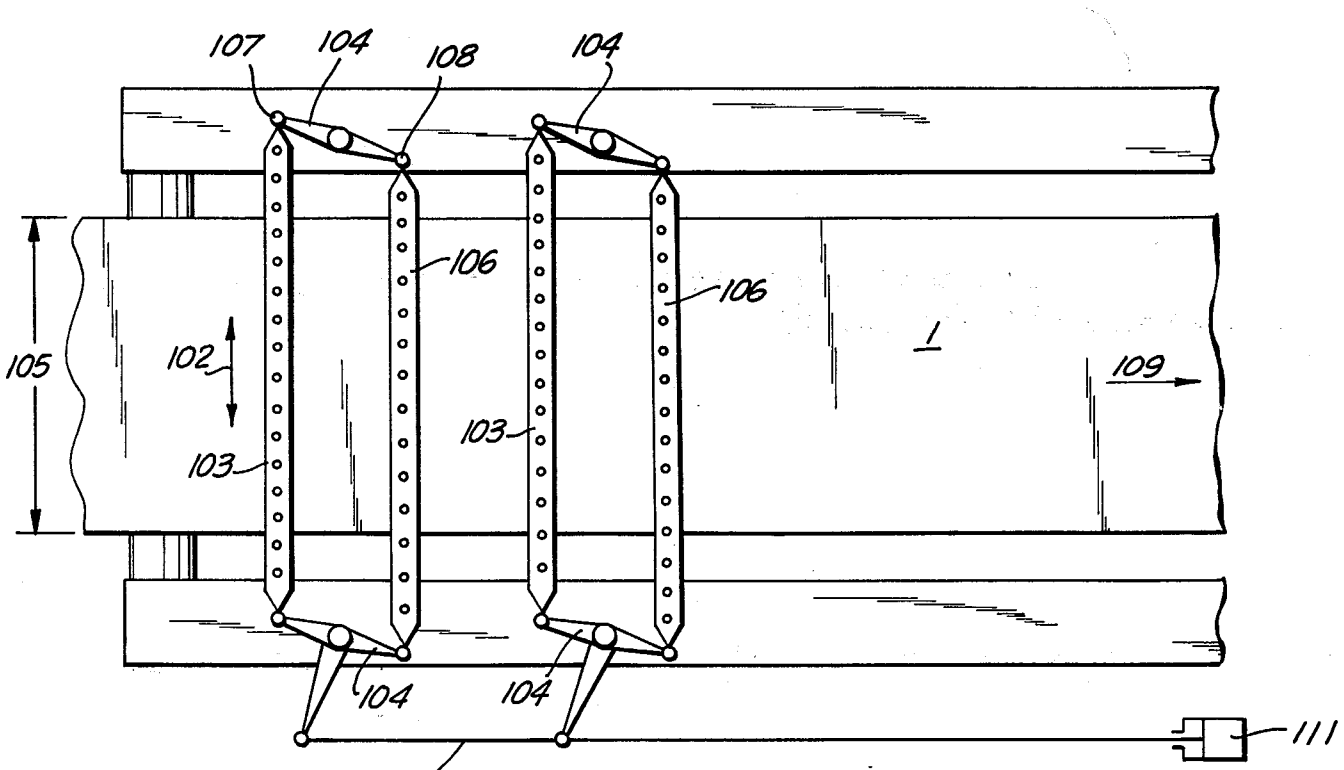
FIG. 12 is a view similar to FIG. 11, illustrating a modification.

In order to imprint substrates with jets trained upon them, as described hereinabove, a nozzle carrier can be mounted fixedly above the substrate which can be moved underneath the nozzles. With a pattern whose design consists of many fine lines, a large number of such stationary nozzles are required so that the system becomes bulky and expensive to manufacture and operate. It is therefore advantageous to use nozzles, especially those of the fast-acting type described above, which are themselves movable so that a single nozzle can apply dyestuff to a substrate zone of considerable width. Such an arrangement greatly reduces the number of nozzles required and also simplifies the associated equipment including pattern readers coacting with a matrix, preamplifiers and power amplifiers designed to convert sensing commands into control pulses for the nozzles. FIGS. 10-12 show such an arrangement designed to produce intricate patterns by relatively simple means.

According to FIG. 10 the substrate 1 is again advanced, as in FIG. 1, on an endless conveyor 2 (or possibly on a stationary support table) past several sets of dyestuff applicators 3 operating in the above-discussed manner. Conveyor 2 is shown led around rollers 94 mounted on a base 95. The imprinted substrate is received in a drying chamber 96.

Suction boxes 5, as shown in FIG. 1, can again be disposed beneath the upper run of the perforated conveyor.

As shown in FIGS. 10 and 11, rails 99 rigid with base 95 extend transversely across the substrate 1 and are engaged by rollers 97 from whose shafts the applicators 3 are suspended. The nozzle arrays can thus be disposed, as indicated by arrows 98, in a direction perpendicular to the direction of travel 101 of the substrate. The rails extend on each side of the substrate beyond the conveyor 2 so as to overhang lateral receptacles 100 designed to receive residual dyestuff in the event of a color change or rinse water after completion of a printing operation.

The shifting of the nozzles in the direction of arrows 98 is accompanied by a modulation of their jets according to a predetermined program. Upon completion of a traverse, the substrate 1 is advanced in the direction 101 by a predetermined increment of movement which can be selected according to the layout of the nozzles and to the desired complexity of the pattern. The applicators 3 can then be returned to their starting point and, in the course of this reverse stroke, again irrigate the substrate 1 with dyestuff. The programmer and the associated control circuits for the opening and closure of the nozzles have not been illustrated. Printing speeds comparable to those of conventional carpet-printing machines, in a range of 3 to 10 meters per minute, can be realized in this manner with the aid of considerably less expensive equipment.

According to FIG. 12, the substrate 1 is spanned by nozzle bars 103, 106 which are articulated to cross-levers 104 to form parallelogramatic linkages therewith. Each bar 106 may, of course, carry more than a single row of nozzles. A piston rod 110 of a hydraulic servomotor 111 controls these linkages so as to make their nozzle bars move alternately in opposite directions, as indicated by an arrow 102, again transversely to the direction of motion of the substrate represented by an arrow 109. The stroke of the joints 107 and 108, and therefore that of each individual nozzle, is only a small fraction of the width 105 of the substrate, amounting for example to 2.5 centimeters while the width 105 may be on the order of meters. The intermittent advance of the substrate is again timed to occur at the end of any stroke.

Figure 13:
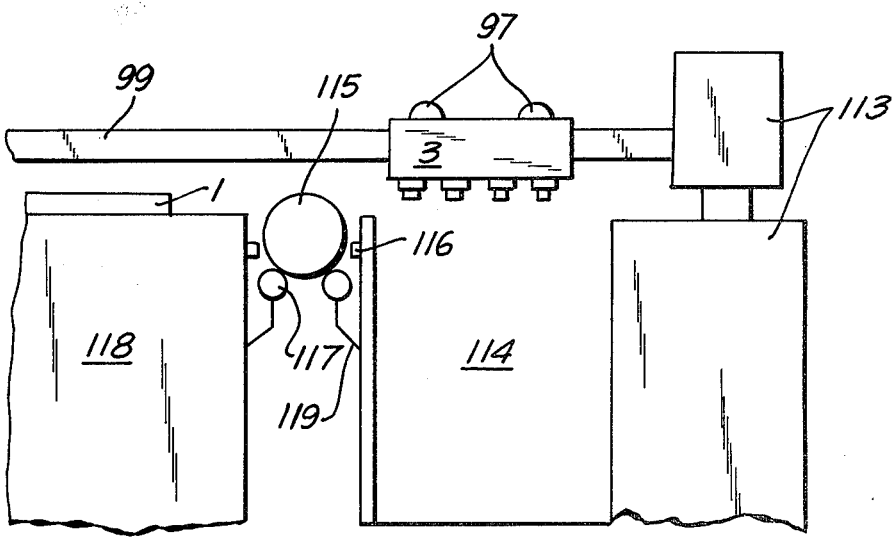
FIG. 13 is a fragmentary, diagrammatic cross-sectional view of a printing machine of the general type shown in preceding Figures, illustrating another detail.

FIG. 13 shows an arrangement for cleaning the nozzles of an applicator 3 in a machine which is generally similar to that shown in FIGS. 10 and 11, except that the conveyor 2 has been replaced by a support table 118. At one or both sides of this table there is provided a cylinder 115 whose surface may be covered by an absorbing foam layer and which contacts the nozzles whenever the applicator 3 moves across it on rails 99. These rails are provided with end mountings 113 separated from the table 118 by a channel 114 which provides easy access to the nozzles for purposes of inspection, replacement or minor repairs. Residual dyestuff and other matter removed from the nozzles by the cylinder 115 are taken off by stripper rolls 117 which are pressed onto the underside of that cylinder with the aid of movable arms 119. Sprinklers 116 flanking the cylinder 115 can be actuated automatically, in certain inoperative positions of the applicator block 3, to irrigate the cylinder surface while the stripper rolls are simultaneously moved upwardly into contact with the cylinder.

Figure 14:
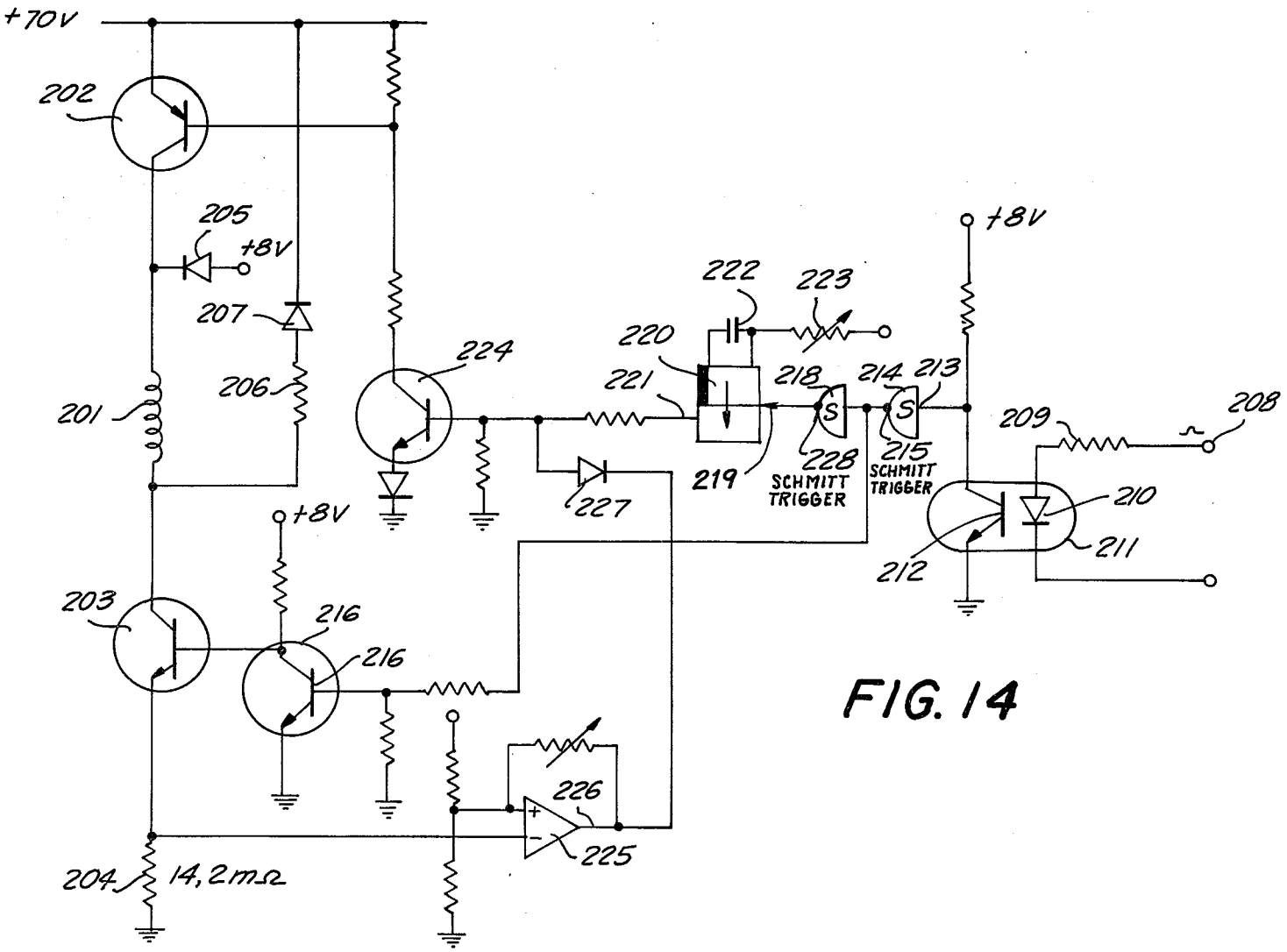
FIG. 14 is a diagram of a control circuit for an electromagnetic ink applicator as shown in FIGS. 5 - 9.

FIG. 14 shows a circuit arrangement for the rapid energization of the electromagnetic coils in the applicators of FIGS. 5 - 9. These coils are represented in FIG. 14 by an inductance 201 inserted between a PNP power transistor 202 and an NPN power transistor 203. Transistor 202, when conducting, briefly connects the coil 201 to positive potential of, say, +70V; simultaneously, of course, the other power transistor 203 must also conduct in order to complete a circuit to ground by way of a low-ohmic resistor 204.

Transistor 202 conducts only for a short period, e.g. of 0.5 ms, causing a steep rise of the current in coil 201. Upon the cutoff of this transistor the coil is energized via a diode 205 with a voltage of +8V. This voltage suffices to maintain a holding current in the coil 201 as long as the transistor 203 conducts. Upon the cutoff of this transistor it is desirable that the coil 201 be de-energized as quickly as possible. For this purpose the end of the coil proximal to the transistor 203 is connected by way of a resistor 206 and a diode 207 to positive potential. In this way the energy stored in the coil is returned to the supply rather than being wastefully converted into heat.

The two power transistors 202 and 203 operate as follows.

A terminal 208 receives a rectangular pulse measuring the period during which the coil 201 is to be energized. This pulse, passing through a resistor 209, energizes a light-emitting diode 210 of an optical coupler 211. A light-responsive transistor 212 in coupler 211 thereupon substantially grounds an input 213 of a Schmitt trigger 214 for the duration of that pulse. During this interval the output 215 of Schmitt trigger 214 carries a signal fed on the one hand to the base 216 of an NPN pilot transistor 217 and on the other hand to a second Schmitt trigger 228. Pilot transistor 217, which is normally conductive, is blocked by this signal and drives the base of power transistor 203 positive, causing it to conduct. The second Schmitt trigger 218 has an inverting output 228 which at this point carries a voltage tripping a monoflop 220 whose off-period is determined by a shunt capacitor 222 and a trimming resistor 223. The output 221 of the monoflop is a brief positive spike which unblocks another pilot transistor 224 which in turn causes power transistor 202 to conduct, thereby completing the energizing circuit for coil 201. At the end of the spike the transistor 202 is again cut off, coil 201 thereupon again receiving the low voltage of +8V through diode 205.

In order to prevent possible multiple responses of monoflop 220 and resulting malfunction of the switching circuit, a current-limiting network is provided. If the monoflop conducts beyond its normal time, the current in coil 201 rises toward objectionable values. Resistor 204, which may have a magnitude of 14.2 milliohms, measures this current flow and cuts off the power transistor 202 if the latter conducts too long. Thus, a rise in the emitter potential of transistor 203 above a predetermined threshold trips an operational amplifier 225 whose output 226 is thereupon grounded, thereby lowering the base potential of pilot transistor 224 via a diode 227 to substantially ground potential so that transistor 202 is blocked.

The invention is not limited to the specific embodiments described and illustrated. The discharges from the nozzles need not be trained onto flat substrates but can be used to form patterns on bodies, hollow or otherwise of any shape. This is possible because the surface of the article to be patterned need not be in contact with a printing screen or with a nozzle. The invention is also particularly useful for the imprinting of substrates, such as plastic sheets, which are especially sensitive to contact and on which successive imprinting by several screen stages would mar the color patterns already applied thereto. The nozzles need not operate with liquid dyestuffs but could also be used for applying gaseous fluids or finely comminuted solids in a gaseous carrier to the surface of a substrate.

I claim:

1. A machine for applying a pattern to a substrate, comprising:

applicator means including at least one nozzle for spraying dyestuff onto a substrate to be patterned, said nozzle being provided with a discharge orifice and with valve means for controlling the rate of discharge of dyestuff through said orifice;

transport means including a perforated conveyor for moving said substrate past said nozzle in the immediate vicinity of said orifice, said transport means including a support roller confronting said nozzle for backstopping a portion of said substrate sprayed with said dyestuff; and suction means for drawing said portion of said substrate onto said conveyor in the vicinity of said nozzle.

2. A machine as defined in claim 1 wherein said suction means comprises a vacuum chamber open toward said conveyor.

3. A machine as defined in claim 2 wherein said vacuum chamber is provided with an adjustable lid positionable alongside said substrate for covering a part of said vacuum chamber extending beyond the width of said substrate.

4. A machine as defined in claim 2 wherein said vacuum chamber is provided with an adjustable internal partition for shutting off a part of said vacuum chamber extending beyond the width of said substrate.

5. A machine for applying a pattern to a substrate, comprising:

applicator means including at least one nozzle for spraying dyestuff onto a substrate to be patterned, said nozzle being provided with a discharge orifice and with valve means for controlling the rate of discharge of dyestuff through said orifice;

transport means for moving said substrate past said nozzle in the immediate vicinity of said orifice, said transport means including a perforated conveyor confronting said nozzle for backstopping a portion of said substrate sprayed with said dyestuff; and suction means for drawing said portion of said substance onto said conveyor in the vicinity of said nozzle, said suction means including a vacuum chamber open toward said conveyor and provided with an adjustable lid positionable alongside said substrate for covering a part of said vacuum chamber extending beyond the width of said substrate.

6. A machine as defined in claim 5 wherein said roller is one of several rollers forming part of said transport means, said rollers defining a curvilinear path for said substrate, said path being convex toward said nozzle whereby said portion of said substrate bends about the roller opposite said orifice.

7. A machine as defined in claim 6 wherein said transport means further includes tensioning means upstream of said rollers for longitudinally stressing said substrate.

8. A machine for applying a pattern to a substrate, comprising:

applicator means including at least one nozzle for spraying dyestuff onto a substrate to be patterned, said nozzle being provided with a discharge orifice and with valve means for controlling the rate of discharge of dyestuff through said orifice, said valve means including a valve needle provided with electromagnetic actuating means for selectively blocking and unblocking said orifice by displacing said needle along an orifice axis; and transport means for moving said substrate past said nozzle in the immediate vicinity of said orifice, said transport means including support means confronting said nozzle for backstopping a portion of said substrate sprayed with said dyestuff.

9. A machine as defined in claim 8 wherein said axis is vertical, said applicator means comprising a housing forming a dyestuff chamber bounded by a carrier for said nozzle and by a flexible diaphragm supporting said needle, said actuating means being disposed outside said dyestuff chamber and engaging an extension of said needle penetrating said diaphragm.

10. A machine as defined in claim 9, further comprising membrane means outside said dyestuff chamber engaging said guiding for axially guiding said needle.

11. A machine as defined in claim 10 wherein said membrane means comprises two parallel membranes axially spaced along said extension.

12. A machine as defined in claim 11 wherein said membranes are disks provided with radial slits for facilitating axial deflections of their central parts.

13. A machine as defined in claim 12 wherein said disks are sheet-metal foils of a thickness not exceeding 1% of their diameters.

14. A machine as defined in claim 9 wherein said housing has a space separated by said diaphragm from said dyestuff chamber, further comprising a source of fluid under pressure communicating with an inlet port of said space for substantially balancing the pressure of dyestuff acting upon said diaphragm. inlet 15. A machine as defined in claim 14 wherein said actuating means includes an electromagnetic armature in said space disposed between said inlet port and a venting aperture of said housing for cooling of said armature by a flow of escaping pressure fluid.

16. A machine as defined in claim 9 wherein said carrier comprises a plate resting against a flat underside of said housing.

17. A machine as defined in claim 9 wherein said needle has a stroke of several tenths of a millimeter.

18. A machine as defined in claim 9 wherein said dyestuff chamber is generally cylindrical about said axis and has a tangential entrance for the alternate admission of dyestuff and cleaning fluid.

19. A machine as defined in claim 8 wherein said electromagnetic actuating means comprises a generally disk-shaped armature centered on said axis, said armature having an axial thickness which increases from the disk periphery inwardly over a first fraction of a radius, then remains substantially constant over a second fraction of a radius and thereafter decreases over a third fraction of a radius.

20. A machine as defined in claim 19 wherein said electromagnetic actuating means further comprises a magnetically permeable coil holder forming a substantially cylindrical sleeve which converges frustoconically toward the disk periphery, the electromagnetic cross-section of said armature along annular zones centered on said axis being about half the magnetic cross-section of said holder along said cylindrical sleeve.

* * * * *